US010729249B2

(12) United States Patent
Shen

(10) Patent No.: US 10,729,249 B2
(45) Date of Patent: Aug. 4, 2020

(54) CHAIR CUSHION AND ITS SUPPORTING STRUCTURE

(71) Applicant: ANJI GRAND ORIENT FURNITURE CO.,LTD, Zhejiang (CN)

(72) Inventor: Guoliang Shen, Zhejiang (CN)

(73) Assignee: ANJI GRAND ORIENT FURNITURE CO., LTD, Zhejiang (CN)

( * ) Notice: Subject to any disclaimer, the term of this patent is extended or adjusted under 35 U.S.C. 154(b) by 90 days.

(21) Appl. No.: 15/915,091

(22) Filed: Mar. 8, 2018

(65) Prior Publication Data

US 2019/0223601 A1 Jul. 25, 2019

(30) Foreign Application Priority Data

Jan. 25, 2018 (CN) ..... 2018 1 0074054

(51) Int. Cl.

| | |
|---|---|
| ***A47C 7/02*** | (2006.01) |
| ***A47C 7/35*** | (2006.01) |
| ***A47C 7/34*** | (2006.01) |
| ***A47C 7/28*** | (2006.01) |

(52) U.S. Cl.

CPC ..... *A47C 7/027* (2013.01); *A47C 7/28* (2013.01); *A47C 7/34* (2013.01); *A47C 7/35* (2013.01)

(58) Field of Classification Search

CPC .. A47C 7/027; A47C 7/34; A47C 7/35; A47C 27/20; A47C 27/04; A47C 7/28

See application file for complete search history.

(56) References Cited

U.S. PATENT DOCUMENTS 1,815,510 A * 7/1931 Hotter ..... A47C 23/30 5/267
2,008,158 A * 7/1935 Van Dresser ..... A47C 7/35 267/94
3,462,779 A * 8/1969 Thompson ..... A47C 27/063 5/655.8
3,616,142 A * 10/1971 Schrotenboer ..... A47C 7/22 442/35

(Continued)

*Primary Examiner* — David R Dunn
*Assistant Examiner* — Tania Abraham
(74) *Attorney, Agent, or Firm* — JCIPRNET

(57) ABSTRACT

The present invention offers a type of chair cushion and its supporting structure, and belongs to the technical field of chair manufacture. It solves the problem of unreasonable design in prior art. The chair cushion and its supporting structure comprise a pair of side boards and a bottom board. The undersides of the pair of side boards are provided at both sides of the bottom board to form a mounting cavity in which are provided several elastic supporting components. Each elastic supporting component includes several vertical springs of identical size and shape and a first flexible cladding. All springs in each elastic supporting components are arranged in at least one row and cladded in the first flexible cladding. The advantages of the chair cushion and its supporting structure lie in that the elastic supporting components formed by the first flexible cladding that clads at least one row of springs promote the strength for supporting person's hip weight on the seat. Due to the promoted buffer capacity, the protection role is enhanced to the person sitting in the seat.

16 Claims, 3 Drawing Sheets

(56) References Cited

U.S. PATENT DOCUMENTS

| | | | | | |
|---|---|---|---|---|---|
| 3,869,739 | A * | 3/1975 | Klein | A47C 27/064 | 5/720 |
| 5,570,874 | A * | 11/1996 | Tornero | F16F 1/08 | 267/100 |
| 5,700,060 | A * | 12/1997 | Bullard | A47C 7/24 | 297/452.5 |
| 6,574,814 | B2 * | 6/2003 | Collard | A47C 27/001 | 5/655.9 |
| 6,658,682 | B1 * | 12/2003 | Wells | A47C 27/062 | 5/655.7 |
| 7,048,263 | B2 * | 5/2006 | Ahlqvist | B68G 9/00 | 267/91 |
| 8,117,700 | B2 * | 2/2012 | Howard | A47C 27/001 | 5/690 |
| 9,131,782 | B1 * | 9/2015 | Baker | A47C 27/062 | |
| 9,414,682 | B1 * | 8/2016 | Mezzera | A47C 7/34 | |
| 9,560,916 | B1 * | 2/2017 | Bullard | A47C 7/22 | |
| 2013/0264857 | A1 * | 10/2013 | Ota | B60N 2/5657 | 297/452.47 |
| 2016/0075081 | A1 * | 3/2016 | Kielinen | B29C 44/1257 | 156/245 |
| 2016/0235204 | A1 * | 8/2016 | Andreotti | A47C 7/20 | |

* cited by examiner

CHAIR CUSHION AND ITS SUPPORTING STRUCTURE

CROSS-REFERENCE TO RELATED APPLICATION

This application claims the priority benefit of China application serial no. 201810074054.0, filed on Jan. 25, 2018. The entirety of the above-mentioned patent application is hereby incorporated by reference herein and made a part of this specification.

BACKGROUND

1. Field of the Invention

The present invention belongs to the technical field of chair manufacture, and especially relates to a type of chair cushion and its supporting structure.

2. Description of Related Art

Chair is a seat with back and armrest and is widely used in office and family. With increasing life level, people have higher desire for chairs: not only firm construction, but also more comfort. When sitting in ordinary chairs, people usually feel all body sinking in the chairs. The chair cushion lacks adequate support for person's hip weight, being unfavorable to keep person's body straight when seated and producing adverse effect to person's spinal column.

SUMMARY

One object of the present invention is to solve the above-mentioned problem by offering a type of chain cushion with rational design and elastic supporting function.

Another object of the present invention is to solve the above-mentioned problem by offering a type of chain cushion having simple structure and comfort seating.

To achieve the above first object, the present invention adopts the following technical scheme: The supporting structure of chair cushion in the present invention comprises a pair of side boards and a bottom board. The undersides of the pair of the side boards are provided at both sides of bottom board to form a mounting cavity in which are provided several elastic supporting components. Each elastic supporting component consists of several vertical springs of identical size and shape and a first flexible cladding. All of the springs in each elastic supporting component are arranged in at least one row and cladded in the first flexible cladding. The elastic supporting components formed by the first flexible cladding that clads at least one row of springs promote the supporting strength for person's hip weight on the chair. Due to the promoted buffer capacity, the protection role is enhanced to the person sitting in the seat. Meanwhile the configuration of the first flexible cladding enhances the absorption of the vibrating sound of springs produced when the person takes the seat.

In the above supporting structure of chair cushion, horizontal elastic rubber bands are provided across the pair of side boards and over the mounting cavity. The configuration of elastic rubber bands in horizontal arrangement further promotes the supporting and buffering power of the chair.

In the above supporting structure of chair cushion, the width of elastic rubber band is at least >1 cm. Thus, the pressure intensity is reduced when seated by increasing elastic supporting area.

In the above supporting structure of chair cushion, neighboring two elastic rubber bands are provided with an interval equal to or less than the width of elastic rubber band, enhancing the homogeneity of the support.

In the above supporting structure of chair cushion, a gap filling layer formed by soft buffering materials is provided between elastic rubber bands and elastic supporting components, to further promote buffering capacity.

In the above supporting structure of chair cushion, the outer diameter in the axial middle section of springs shall be at least 2.5 cm, and the pitch in the axial middle section of spring shall be at least half the outer diameter in the axial middle section of springs. Meanwhile ensuring their supporting performance, the spring prolongs compression time by the design of the large pitch and promotes the seating comfort by the design of the large outer diameter.

In the above supporting structure of chair cushion, the size of the pitch gradually decreases from axial middle section to both axial ends, and the outer diameters of both axial ends is slightly smaller than that of middle section. The configuration of gradual decrease of the pitch from the middle section to both ends strengthens the outward supporting force of the spring when compressed, while the configuration of outer diameter of both axial ends of the spring is slightly smaller than that of the middle section enlarges the contacting outward area of the spring when compressed, thus promoting the stability of support.

In the above supporting structure of chair cushion, the springs in the elastic supporting component are arranged in two rows. All springs in each elastic supporting component are arranged along the longitudinal direction of side board, enhancing the stability of support.

In the above supporting structure of chair cushion, the outside of each spring in the elastic supporting component is tightly wrapped by the second flexible cladding. The first flexible cladding is net gauze with meshes. The configuration of the second flexible cladding further enhanced the absorption of spring vibrating sound produced when seated.

In the above supporting structure of chair cushion, the second flexible cladding at the axial end of all springs in the elastic supporting components is solidly connected with a third flexible cladding, while the second flexible cladding at the other axial end is solidly connected with the other third flexible cladding, making more convenient cladding of first flexible cladding around springs and enhancing the absorption of vibrating sound of the springs.

To achieve the above second object, the present invention adopts the following technical scheme: the chair cushion of the present invention comprises external members provided at external layer and all supporting structures in claims 1 to 10. The external members wrap the supporting structure with a good bracing, promoting seating comfort.

In the above supporting structure of chair cushion, an intermediate filling layer filled with soft material is provided between external members 6*nd* supporting structures. The soft material comprises high density sponge with a density between 20 and 28 to promote seat comfort.

In the above supporting structure of chair cushion, several stuffing bags are provided in the interior of external members to fill stuffing material. Different soft materials can be chosen as needed, expanding applicable range.

Compared to the prior art, the advantages of the chair cushion and its supporting structure lie in that the elastic supporting components formed by the first flexible cladding that clads at least one row of springs promote the strength supporting person's hip weight on the chair. Due to the promoted buffer capacity, the protection role is enhanced to the person sitting in the seat. Meanwhile the configuration of first flexible cladding enhances the absorption of the vibrating sound of springs produced when the person takes the seat. The configuration of elastic rubber bands in horizontal arrangement further promotes the supporting and buffering power of the chair.

BRIEF DESCRIPTION OF THE DRAWINGS

Further features and advantages of the invention shall become more readily apparent from the detailed description that illustrate an implementation of the present invention or the technical scheme in prior art. Obviously, the following description of the drawings are only some embodiments of the present invention and those skilled in the art can also obtain other designs based on these drawings without paying creative work.

With reference to the aforementioned figures, the reference number 11 indicates side board, 12 bottom board, 13 mounting cavity, 2 connecting piece, 31 spring, 32 first flexible cladding, 33 second flexible cladding, 34 third flexible cladding, 4 elastic rubber band, 5 gap filling layer, 6 external member, 7 intermediate filling layer, 8 stuffing bag, and 9 armrest connecting piece.

DESCRIPTION OF THE EMBODIMENTS

Reference will now be made in greater detail to exemplary examples of the present invention by referring to the accompanying drawings. The following examples are used to explain the invention and not intended to limit the invention to the particular embodiment which is described.

Figure 1:
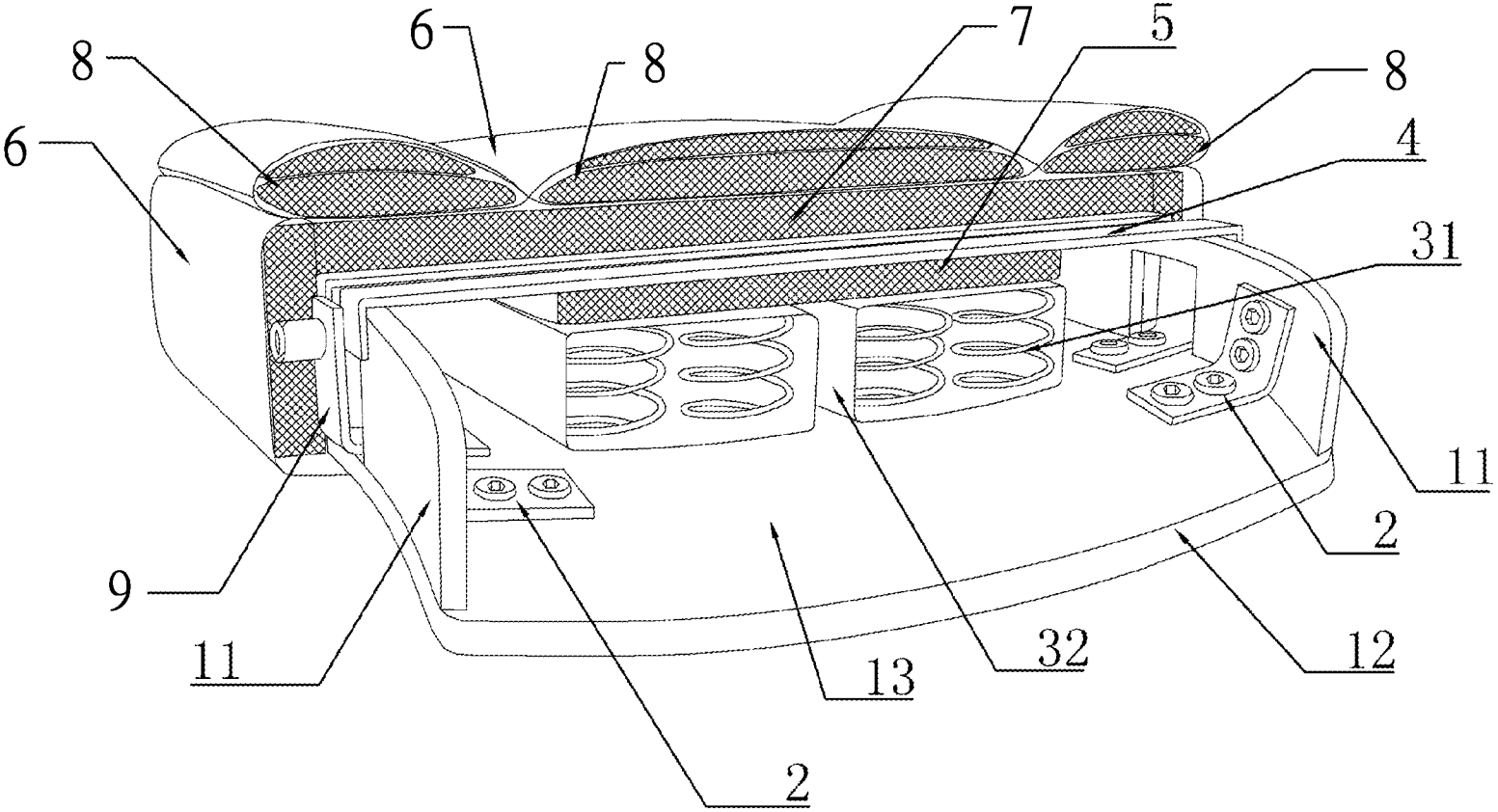
FIG. 1 is a sectional view of the present invention.
Figure 2:
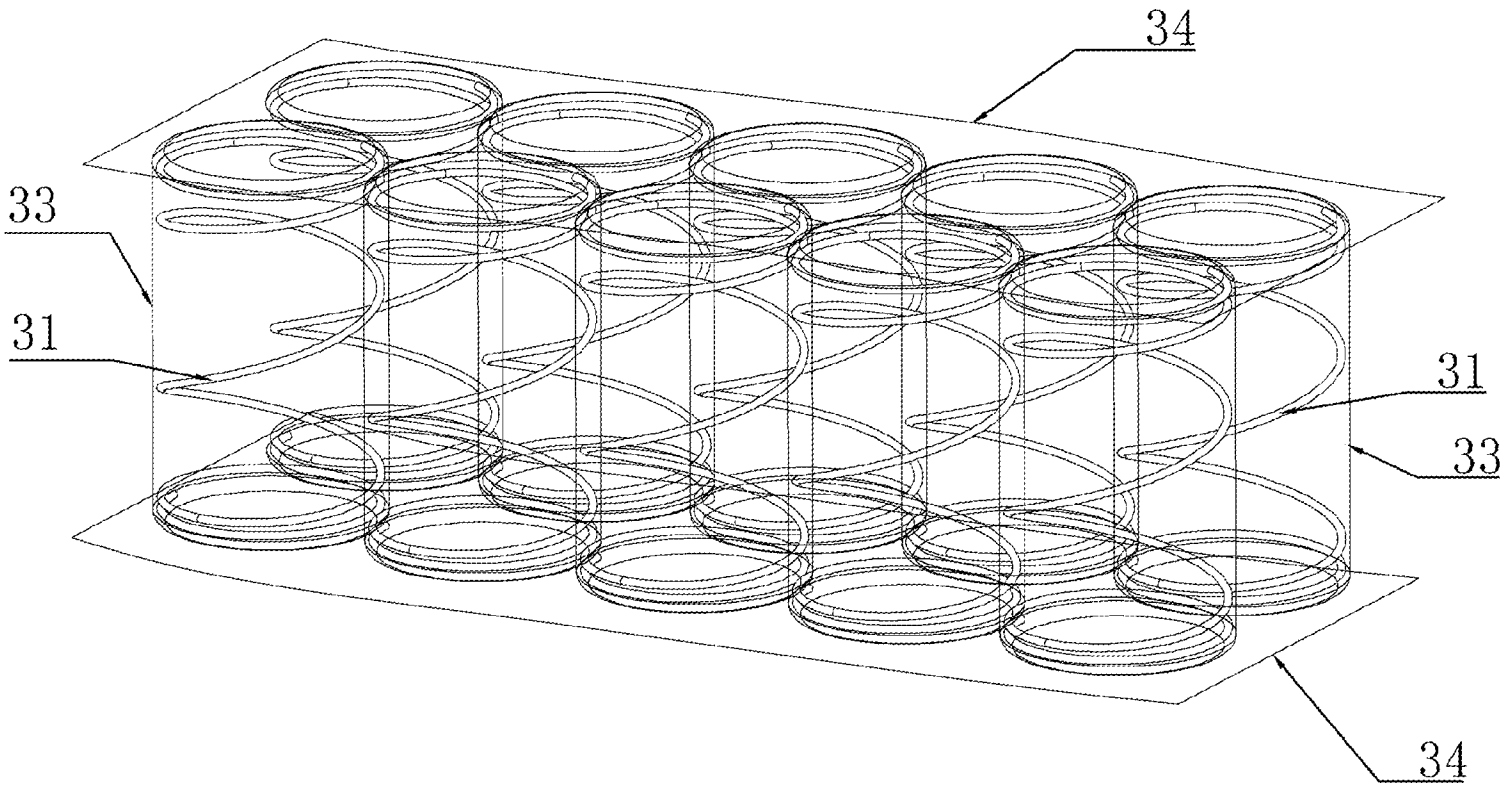
FIG. 2 is a schematic view of elastic supporting component in the present invention without the first flexible cladding.
Figure 3:
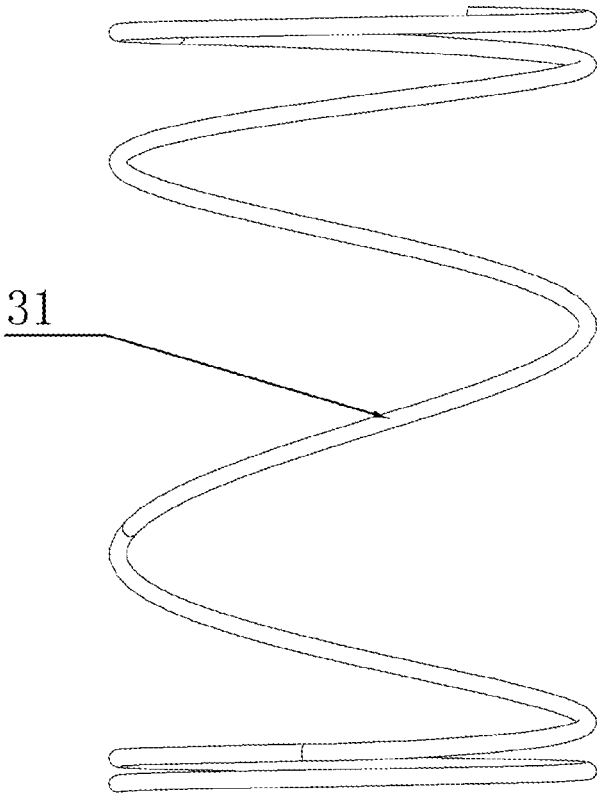
FIG. 3 is a schematic view of the spring in the present invention.

As shown in FIG. 1 to 3, the supporting structure of chair cushion in the present invention comprises a pair of side board 11 and a bottom board 12. The undersides of the pair of side board 11 are provided at both sides of the bottom board 12 to form a mounting cavity 13 in which are provided several elastic supporting components. Each elastic supporting component comprises several vertical springs 31 of identical size and shape and a first flexible cladding 32. All of the springs 31 in each elastic supporting component are arranged in at least one row and cladded in the first flexible cladding 32. The elastic supporting components formed by the first flexible cladding that clads at least one row of springs 31 promote the strength supporting person's hip weight on the seat. Due to the promoted buffer capacity, the protection role is enhanced to the person sitting in the seat. Meanwhile the configuration of first flexible cladding 32 enhances the absorption of the vibrating sound of spring 31 produced when the person takes the seat.

There are multiple ways of connecting the side boards 11 and the bottom board 12. For example, the undersides of the pair of the side boards 11 can be connected to both sides of bottom board 12 with several connecting pieces 2 that can be screws, rivets or preferably angle iron, both sides of which can be connected to the side boards 11 and the bottom board 12 with screws or rivets. Moreover, the side boards 11 and the bottom board 12 can be bonded together by glue, or even the side boards 11 and the bottom board 12 can adopt integral structure. The cross sectional shape of mounting cavity 13 may have the same or different width from top to bottom as specifically needed.

Preferably, the longitudinal front end of the bottom board 12 bends outwards and downwards to a section that is comfortable for legs of the persons taking the seat. Armrest connecting pieces 9 that penetrate the through hole on the side boards 11 to connect the armrest of the seat are provided at both sides of the bottom board 12.

Horizontal elastic rubber bands 4 are provided across the pair of side boards 11 and over the mounting cavity 13. Preferably, the elastic rubber bands 4 may be appropriately strained when horizontally mounted to form some elastic deformation, so that better supporting power can be obtained when a person takes the seat. The configuration of the elastic rubber bands 4 in horizontal arrangement further promotes the supporting and buffering power of the chair. The width of the elastic rubber bands 4 shall be more than 1 cm and can be selected in a range between 2.0 and 4.0 cm, preferably 2.5, 3.0 or 3.5 cm, so as to reduce the pressure intensity when seated by increasing elastic supporting area. The neighboring two elastic rubber bands 4 are provided with an interval equal to or less than the width of the elastic rubber bands 4, enhancing the homogeneity of the support. A gap filling layer 5 formed by a soft buffering material is provided between the elastic rubber bands 4 and the elastic supporting components to further promote buffering capacity. Preferably, the stuffing material for the gap filling layer 5 is sponge with a high density between 20 and 28 and a rigidity between 42 and 57. The outer diameter in the axial middle sections of the springs 31 shall be at least 2.5 cm, and the pitches in the axial middle sections of springs 31 shall be at least half the outer diameter in the axial middle sections of springs 31. Meanwhile ensuring their supporting performance, springs 31 prolong compression time by the design of the large pitch and promotes the seating comfort by the design of the large outer diameter. The diameter range of spring 31 is 3.5-5.5 cm, preferably 4.0, 4.5 or 5.0 cm, and the range of the pitch is 3-6 cm, preferably 3.5, 4.0, 4.5 or 5.5 cm. The springs 31 in the elastic supporting components are arranged in two rows. All springs 31 in each elastic supporting components are arranged along the longitudinal direction of side boards 11 to enhance supporting stability. The arrangement of the elastic supporting components longitudinally along the side board 11 makes larger frictional force along the side board 11 between the elastic supporting components and the bottom board 12 and prevents the elastic supporting components from sliding along the bottom board 12.

Furthermore, the radial outside of each spring 31 in the elastic supporting components is cladded by a second flexible cladding 33. The first flexible cladding 32 is a net gauze that is provided with meshes. The configuration of the second flexible cladding 33 further promotes the absorption of the vibrating sound of springs 31 when seated. The second flexible cladding 33 at the axial end of all springs 31 in the elastic supporting components is solidly connected with a third flexible cladding 34, while the second flexible cladding 33 at the other axial end is solidly connected with the other third flexible cladding 34. Preferably, bonding with environmental glue is adopted for the connection, making more convenient cladding of first flexible cladding 32 around the springs and enhancing the absorption of the vibrating sound of springs. The connecting pieces 2 are provided at both of the side boards 11 in pairs, thus enhancing the fastness of connection. Preferably, both of the second flexible claddings 33 and the third flexible claddings 34 are made of nonwoven fabrics.

As shown in FIG. 1, the chair cushion of the present invention comprises external members 6 provided at external layer and all supporting structures in claims 1 to 10. The external members 6 wrap the supporting structure with a good bracing.

Specifically, the external members 6 may be made of a leather material or a weaving cloth. An intermediate filling layer 7 filled with soft material is provided between external members 6 and supporting structures. The soft material comprises high density sponge with a density between 20 and 28 to promote seat comfort. Preferably, the rigidity of sponge is in the range between 61 and 76. Several stuffing bags 8 are provided in the interior of external members 6 to fill stuffing material. Different soft materials can be chosen as needed, generally sponge with a preferable density between 20 and 28 and a rigidity between 42 and 57, expanding applicable range. Preferably, stuffing bags 8 can also be filled with multiple different soft materials, for instance, elastic floc at upper layer and sponge at lower layer.

The specific embodiments described in this patent are only examples of the spirit of the invention. It will be obvious to those skilled in the art that variations, supplementation or replacement with similar mode may be made in the construction and relation of parts without departing from the spirit and scope of the invention described herein.

Although the terms such as side board 11, bottom board 12, mounting cavity 13, connecting piece 2, spring 31, first flexible cladding 32, second flexible cladding 33, third flexible cladding 34, elastic rubber band 4, gap filling layer 5, external members 6, intermediate filling layer 7, stuffing bags 8, and armrest connecting pieces 9, are frequently used, the other terms are not excluded for possible use. These terms are used only for describe and explain the nature of the present invention more conveniently. It is contrary to the spirit of the invention to interpret them as any additional restrictions.

What is claimed is:

1. A supporting structure of a chair cushion, comprising:
a bottom board;
a pair of side boards, wherein undersides of the pair of the side boards are provided at both sides of the bottom board to form a mounting cavity;
several elastic supporting components disposed in the mounting cavity; and
horizontal elastic rubber bands provided across the pair of the side boards and over the mounting cavity, wherein a width of the elastic rubber bands is greater than 1 cm,
wherein each of the elastic supporting components comprises several vertical springs of identical size and shape as well as a first flexible cladding, and all springs in each of the elastic supporting components are arranged in at least one row and cladded in the first flexible cladding,
wherein the springs in the elastic supporting components are arranged in two rows, and all springs in each of the elastic supporting components are arranged along a longitudinal direction of the side boards.

2. The supporting structure of claim 1, further comprising a gap filling layer formed by a soft buffering material and disposed between the elastic rubber bands and the elastic supporting components.

3. The supporting structure of claim 1, wherein an outer diameter of an axial middle sections of the springs is at least 2.5 cm, and a pitch in the axial middle sections of the springs is at least half of the outer diameter of the axial middle sections of the springs.

4. The supporting structure of claim 3, wherein a size of the pitch gradually decreases from the axial middle sections to both axial ends of the springs, and an outer diameter of the both axial ends is slightly smaller than the outer diameter of the middle sections.

5. A chair cushion, comprising:
the supporting structure of claim 1; and
external members wrapping the supporting structure.

6. The chair cushion of claim 5, further comprising an intermediate filling layer filled with a soft material and provided between the external members and the supporting structure, and the soft material comprises a high density sponge with a density between 20 and 28.

7. The chair cushion of claim 5, further comprising several stuffing bags provided in an interior of the external members and filled with a stuffing material.

8. The chair cushion of claim 5, wherein two neighboring elastic rubber bands are provided with an interval equal to or less than the width of the elastic rubber bands.

9. The chair cushion of claim 5, further comprising a gap filling layer formed by a soft buffering material and disposed between the elastic rubber bands and the elastic supporting components.

10. The chair cushion of claim 5, wherein a size of a pitch in an axial middle sections of the springs gradually decreases from the axial middle sections to both axial ends of the springs, and an outer diameter of the both axial ends is slightly smaller than an outer diameter of the middle sections.

11. The chair cushion of claim 5, wherein a second flexible cladding at two axial ends of all springs in the elastic supporting components are solidly connected with a third flexible cladding, respectively.

12. The chair cushion of claim 5, wherein an outside of the springs in the elastic supporting components are tightly wrapped by a second flexible cladding, and the first flexible cladding is net gauze with meshes.

13. The chair cushion of claim 12, wherein the second flexible cladding at two axial ends of all springs in the elastic supporting components are respectively and solidly connected with a third flexible cladding.

14. A supporting structure of a chair cushion, comprising:
a bottom board;
a pair of side boards, wherein undersides of the pair of the side boards are provided at both sides of the bottom board to form a mounting cavity;
several elastic supporting components disposed in the mounting cavity; and
horizontal elastic rubber bands provided across the pair of the side boards and over the mounting cavity, wherein a width of the elastic rubber bands is greater than 1 cm,
wherein each of the elastic supporting components comprises several vertical springs of identical size and shape as well as a first flexible cladding, and all springs in each of the elastic supporting components are arranged in at least one row and cladded in the first flexible cladding,
wherein two neighboring elastic rubber bands are provided with an interval equal to or less than the width of the elastic rubber bands.

15. A supporting structure of a chair cushion, comprising:
a bottom board;
a pair of side boards, wherein undersides of the pair of the side boards are provided at both sides of the bottom board to form a mounting cavity;
several elastic supporting components disposed in the mounting cavity; and horizontal elastic rubber bands provided across the pair of the side boards and over the mounting cavity, wherein a width of the elastic rubber bands is greater than 1 cm, wherein each of the elastic supporting components comprises several vertical springs of identical size and shape as well as a first flexible cladding, and all springs in each of the elastic supporting components are arranged in at least one row and cladded in the first flexible cladding, wherein an outside of the springs in the elastic supporting components are tightly wrapped by a second flexible cladding, and the first flexible cladding is net gauze with meshes.

16. The supporting structure of claim 15, wherein the second flexible cladding at two axial ends of all springs in the elastic supporting components are respectively and solidly connected with a third flexible cladding.

* * * * *